US009289350B2

(12) United States Patent
Helgeson et al.

(10) Patent No.: US 9,289,350 B2
(45) Date of Patent: Mar. 22, 2016

(54) AIR PULSATOR CONTROL SYSTEM

(75) Inventors: Lonnie J. Helgeson, New Prague, MN (US); Michael W. Larson, New Prague, MN (US)

(73) Assignee: ELECTROMED, INC., New Prague, MN (US)

( * ) Notice: Subject to any disclaimer, the term of this patent is extended or adjusted under 35 U.S.C. 154(b) by 699 days.

(21) Appl. No.: 13/600,216

(22) Filed: Aug. 31, 2012

(65) Prior Publication Data

US 2013/0331747 A1 Dec. 12, 2013

Related U.S. Application Data

(60) Provisional application No. 61/573,238, filed on Sep. 2, 2011.

(51) Int. Cl.

| | |
|---|---|
| ***A61H 23/04*** | (2006.01) |
| ***A61H 9/00*** | (2006.01) |
| *A61H 31/00* | (2006.01) |

(52) U.S. Cl.

CPC ..... *A61H 23/04* (2013.01); *A61H 9/0078* (2013.01); *A61H 31/00* (2013.01); *A61H 2201/0157* (2013.01); *A61H 2201/1215* (2013.01); *A61H 2201/165* (2013.01); *A61H 2201/1619* (2013.01); *A61H 2201/5035* (2013.01); *A61H 2205/084* (2013.01); *A61H 2209/00* (2013.01)

(58) Field of Classification Search

CPC ..... A61H 2031/025; A61H 9/005; A61H 9/0071; A61H 9/0078–9/0092; A61H 23/04

See application file for complete search history.

(56) References Cited

U.S. PATENT DOCUMENTS

| | | | | |
|---|---|---|---|---|
| 1,266,252 | A | | 5/1917 | Hadford |
| 2,588,192 | A | * | 3/1952 | Akerman et al. ..... 601/44 |
| 3,120,192 | A | | 2/1964 | Winchell |
| 3,333,581 | A | * | 8/1967 | Robinson et al. ..... 601/44 |
| 3,818,806 | A | | 6/1974 | Fumagalli |
| 4,058,857 | A | | 11/1977 | Runge et al. |
| 4,838,263 | A | | 6/1989 | Warwick et al. |
| 4,957,107 | A | | 9/1990 | Sipin |
| 5,056,505 | A | | 10/1991 | Warwick et al. |
| 5,086,767 | A | | 2/1992 | Legal |
| 5,134,995 | A | * | 8/1992 | Gruenke et al. ..... 128/204.23 |
| 5,769,797 | A | | 6/1998 | Van Brunt et al. |
| 5,769,800 | A | | 6/1998 | Gelfand |
| 6,036,662 | A | | 3/2000 | Van Brunt et al. |
| 6,547,749 | B2 | | 4/2003 | Hansen |
| 6,676,614 | B1 | | 1/2004 | Hansen et al. |
| 7,121,808 | B2 | | 10/2006 | Van Brunt et al. |
| 7,374,550 | B2 | | 5/2008 | Hansen et al. |
| 7,537,575 | B2 | | 5/2009 | Hansen et al. |
| 7,578,293 | B2 | | 8/2009 | Matthiessen |

(Continued)

OTHER PUBLICATIONS

International Search Report Dated October 31, 2013 in Corresponding International Patent Application PCT/US2013/000200.

(Continued)

*Primary Examiner* — Valerie L Skorupa
(74) *Attorney, Agent, or Firm* — Winthrop & Weinstine, P.A.

(57) ABSTRACT

A device and method coupled to a therapy garment to apply pressure and repetitive compression forces to a body of a person has an air pulsator and a user programmable time, frequency and pressure controller operable to regulate the duration of operation, frequency of the air pulses and a selected air pressure applied to the body of a person.

21 Claims, 7 Drawing Sheets

(56) References Cited

U.S. PATENT DOCUMENTS

| | | | | |
|---|---|---|---|---|
| 7,713,219 | B2 | 5/2010 | Helgeson et al. | |
| 2002/0016560 | A1* | 2/2002 | Hansen | 601/48 |
| 2007/0093731 | A1* | 4/2007 | Warwick et al. | 601/41 |
| 2008/0086062 | A1* | 4/2008 | Hansen et al. | 601/44 |
| 2010/0288364 | A1 | 11/2010 | Singh et al. | |

OTHER PUBLICATIONS

Written Opinion of International Searching Authority in Corresponding International Patent Application PCT/2013/000200.

* cited by examiner

AIR PULSATOR CONTROL SYSTEM

CROSS REFERENCE TO RELATED APPLICATION

This application claims the priority of U.S. Provisional Application Ser. No. 61/573,238 filed Sep. 2, 2011.

FIELD OF THE INVENTION

The invention relates to a medical device operable with a thoracic therapy garment to apply repetitive compression forces to the body of a person to aid blood circulation, loosen and eliminate mucus from the lungs and trachea and relieve muscular and nerve tensions.

BACKGROUND OF THE INVENTION

Clearance of mucus from the respiratory tract in healthy individuals is accomplished primarily by the body's normal mucociliary action and cough. Under normal conditions these mechanisms are very efficient. Impairment of the normal mucociliary transport system or hypersecretion of respiratory mucus results in an accumulation of mucus and debris in the lungs and can cause severe medical complications such as hypoxemia, hypercapnia, chronic bronchitis and pneumonia. These complications can result in a diminished quality of life or even become a cause of death. Abnormal respiratory mucus clearance is a manifestation of many medical conditions such as pertussis, cystic fibrosis, atelectasis, bronchiectasis, cavitating lung disease, vitamin A deficiency, chronic obstructive pulmonary disease, asthma, immotile cilia syndrome and neuromuscular conditions. Exposure to cigarette smoke, air pollutants and viral infections also adversely affect mucociliary function. Post surgical patients, paralyzed persons, and newborns with respiratory distress syndrome also exhibit reduced mucociliary transport.

Chest physiotherapy has had a long history of clinical efficacy and is typically a part of standard medical regimens to enhance respiratory mucus transport. Chest physiotherapy can include mechanical manipulation of the chest, postural drainage with vibration, directed cough, active cycle of breathing and autogenic drainage. External manipulation of the chest and respiratory behavioral training are accepted practices. The various methods of chest physiotherapy to enhance mucus clearance are frequently combined for optimal efficacy and are prescriptively individualized for each patient by the attending physician.

Cystic fibrosis (CF) is the most common inherited life-threatening genetic disease among Caucasians. The genetic defect disrupts chloride transfer in and out of cells, causing the normal mucus from the exocrine glands to become very thick and sticky, eventually blocking ducts of the glands in the pancreas, lungs and liver. Disruption of the pancreatic glands prevents secretion of important digestive enzymes and causes intestinal problems that can lead to malnutrition. In addition, the thick mucus accumulates in the lung's respiratory tracts, causing chronic infections, scarring, and decreased vital capacity. Normal coughing is not sufficient to dislodge these mucus deposits. CF usually appears during the first 10 years of life, often in infancy. Until recently, children with CF were not expected to live into their teens. However, with advances in digestive enzyme supplementation, anti-inflammatory therapy, chest physical therapy, and antibiotics, the median life expectancy has increased to 30 years with some patients living into their 50s and beyond. CF is inherited through a recessive gene, meaning that if both parents carry the gene, there is a 25 percent chance that an offspring will have the disease, a 50 percent chance they will be a carrier and a 25 percent chance they will be genetically unaffected. Some individuals who inherit mutated genes from both parents do not develop the disease. The normal progression of CF includes gastrointestinal problems, failure to thrive, repeated and multiple lung infections, and death due to respiratory insufficiency. While some persons experience grave gastrointestinal symptoms, the majority of CF persons (90 percent) ultimately succumb to respiratory problems.

Virtually all persons with CF require respiratory therapy as a daily part of their care regimen. The buildup of thick, sticky mucus in the lungs clogs airways and traps bacteria, providing an ideal environment for respiratory infections and chronic inflammation. This inflammation causes permanent scarring of the lung tissue, reducing the capacity of the lungs to absorb oxygen and, ultimately, sustain life. Respiratory therapy must be performed, even when the person is feeling well, to prevent infections and maintain vital capacity. Traditionally, care providers perform Chest Physical Therapy (CPT) one to four times per day. CPT consists of a person lying in one of twelve positions while a caregiver "claps" or pounds on the chest and back over each lobe of the lung. To treat all areas of the lung in all twelve positions requires pounding for half to three-quarters of an hour along with inhalation therapy. CPT clears the mucus by shaking loose airway secretions through chest percussions and draining the loosened mucus toward the mouth. Active coughing is required to ultimately remove the loosened mucus. CPT requires the assistance of a caregiver, often a family member but a nurse or respiratory therapist if one is not available. It is a physically exhausting process for both the CF person and the caregiver. Patient and caregiver non-compliance with prescribed protocols is a well-recognized problem that renders this method ineffective. CPT effectiveness is also highly technique sensitive and degrades as the giver becomes tired. The requirement that a second person be available to perform the therapy severely limits the independence of the CF person.

Persons confined to beds and chairs having adverse respiratory conditions, such as CF and airway clearance therapy, are treated with pressure pulsating devices that subject the person's thorax with high frequency pressure pulses to assist the lung breathing functions and blood circulation. The pressure pulsating devices are operatively coupled to thoracic therapy garments adapted to be worn around the person's upper body. In hospital, medical clinic, and home care applications, persons require easy application and low cost disposable thoracic garments connectable to portable air pressure pulsating devices that can be selectively located adjacent the left or right side of the persons.

Artificial respiration devices for applying and relieving pressure on the chest of a person have been used to assist in lung breathing functions, and loosening and eliminating mucus from the lungs of CF persons. Subjecting the person's chest and lungs to pressure pulses or vibrations decreases the viscosity of lung and air passage mucus, thereby enhancing fluid mobility and removal from the lungs. An example of a body pulsating method and device disclosed by C. N. Hansen in U.S. Pat. No. 6,547,749, incorporated herein by reference, has a case accommodating an air pressure and pulse generator. A handle pivotally mounted on the case is used as a hand grip to facilitate transport of the generator. The case including the generator must be carried by a person to different locations to provide treatment to individuals in need of respiratory therapy. These devices use thoracic therapy garments having air-accommodating air cores that surround the chests of persons. Examples of garments used with a body pulsating device is disclosed by C. N. Hansen and L. J. Helgeson in U.S. Pat. Nos. 6,676,614 and 7,374,550. The garment is used with an air pressure and pulse generator. Mechanical mechanisms, such as solenoid or motor-operated air valves, bellows and pistons are disclosed in the prior art to supply air under pressure to diaphragms and bladders in regular pattern or pulses. Manually operated controls are used to adjust the pressure of the air and air pulse frequency for each person treatment and during the treatment. The garment worn around the thorax of the CF person repeatedly compresses and releases the thorax at frequencies as high as 25 cycles per second. Each compression produces a rush of air through the lobes of the lungs that shears the secretions from the sides of the airways and propels them toward the mouth where they can be removed by normal coughing. Examples of chest compression medical devices are disclosed in the following U.S. Patents.

W. J. Warwick and L. G. Hansen in U.S. Pat. Nos. 4,838,263 and 5,056,505 disclose a chest compression apparatus having a chest vest surrounding a person's chest. A motor-driven rotary valve located in a housing located on a table allows air to flow into the vest and vent air therefrom to apply pressurized pulses to the person's chest. An alternative pulse pumping system has a pair of bellows connected to a crankshaft with rods operated with a dc electric motor. The speed of the motor is regulated with a controller to control the frequency of the pressure pulses applied to the vest. The patient controls the pressure of the air in the vest by opening and closing the end of an air vent tube. The apparatus must be carried by a person to different locations to provide treatment to persons in need of respiratory therapy.

M. Gelfand in U.S. Pat. No. 5,769,800 discloses a cardiopulmonary resuscitation system having a pneumatic control unit equipped with wheels to allow the control unit to be moved along a support surface.

N. P. Van Brunt and D. J. Gagne in U.S. Pat. Nos. 5,769,797 and 6,036,662 disclose an oscillatory chest compression device having an air pulse generator including a wall with an air chamber and a diaphragm mounted on the wall and exposed to the air chamber. A rod pivotally connected to the diaphragm and rotatably connected to a crankshaft transmits force to the diaphragm during rotation of the crankshaft. An electric motor drives the crankshaft at selected controlled speeds to regulate the frequency of the air pulses generated by the moving diaphragm. A blower delivers air to the air chamber to maintain a positive above atmospheric pressure of the air in the chamber. Controls for the motors that move the diaphragm and rotate the blower are responsive to the air pressure pulses and pressure of the air in the air chamber. These controls have air pulse and air pressure responsive feedback systems that regulate the operating speeds of the motors to control the pulse frequency and air pressure in the vest. The air pulse generator is a mobile unit having a handle and a pair of wheels.

C. N. Hansen in U.S. Pat. No. 6,547,749 also discloses a body pulsating apparatus having diaphragms operatively connected to a motor to generate air pressure pulses directed to a thoracic therapy garment that subjects a person's body to high frequency pressure forces. A first manual control operates to control the speed of the dc motor to regulate the frequency of the air pressure pulses. A second manual control operates an air flow control valve to adjust the pressure of the air directed to the garment thereby regulating the garment pressure on the person's body. An increase or decrease of the speed of the motor changes the frequency of the air pressure pulses and the vest pressure on the person's body. The second manual control must be used by the person or caregiver to adjust the garment pressure to maintain a selected garment pressure.

C. N. Hansen, P. C. Cross and L. H. Helgeson in U.S. Pat. No. 7,537,575 discloses a method and apparatus for applying pressure and high frequency pressure pulses to the upper body of a person. A first user programmable memory controls the time of operation of a motor that operates the apparatus to control the duration of the supply of air under pressure and air pressure pulses to a thoracic therapy garment located around the upper body of the person. A second user programmable memory controls the speed of the motor to regulate the frequency of the air pressure pulses directed to the garment. A manual operated air flow control valve adjusts the pressure of air directed to the garment thereby regulating the garment pressure on the person's upper body. An increase or decrease of the speed of the motor changes the frequency of the air pressure pulses and changes the garment pressure on the person's upper body. The manually operated air flow control valve must be used by the person or caregiver to maintain a selected garment pressure. The garment pressure is not programmed to maintain a selected garment pressure.

N. P. Van Brunt and M. A. Weber in U.S. Pat. No. 7,121,808 discloses a high frequency air pulse generator having an air pulse module with an electric motor. The module includes first and second diaphragm assemblies driven with a crankshaft operatively connected to the electric motor. The air pulse module oscillates the air in a sinusoidal waveform pattern within the air chamber assembly at a selected frequency. A steady state air pressure is established in the air chamber with a blower driven with a separate electric motor. A control board carries electronic circuitry for controlling the operation of the air pulse module. Heat dissipating structure is used to maximize the release of heat from the heat generated by the electronic circuitry and electric motors.

SUMMARY OF THE INVENTION

The invention is a medical device used to deliver high-frequency chest wall oscillations to promote airway clearance and improve bronchial drainage in humans. The primary components of the device include an air pulse generator with user programmable time, frequency and pressure controls, an air inflatable thoracic therapy garment, and a flexible hose coupling the air pulse generator to the garment for transmitting air pressure and pressure pulses from the air pulse generator to the garment. The air pulse generator has an air displacer assembly that provides consistent and positive air displacement, air pressure and air flow to the garment. The air displacer assembly has two rigid one-piece members that move relative to each other to draw air from an air flow control valve and discharge air pressure pulses at selected frequencies to the garment. Power transmissions angularly move the members in opposite directions. A variable speed electric motor regulated with a programmable controller is drivably connected to the power transmissions. The thoracic therapy garment has an elongated flexible body or air core having a plurality of elongated generally parallel chambers for accommodating air. An air inlet connector joined to a lower portion of the body is releasably coupled to a flexible hose joined to the air pulse outlet of the air pulse generator. The thoracic therapy garment may be reversible with a single air inlet connector that can be accessed from either side of a person's bed or chair. The air pulse generator includes a housing supporting air pulse generator controls for convenient use. The air pulse generator controls include user interactive controls for activating an electronic memory program to regulate the time or duration of operation of the air pulse generator, the frequency of the air pulses and the pressure of the air pulses directed to the thoracic therapy garment. The pressure of the air established by the air pulse generator is coordinated with the frequency of the air pulses whereby the air pressure is substantially maintained at a selected pressure when the air pulse frequency is changed.

DESCRIPTION OF INVENTION

Figure 1:
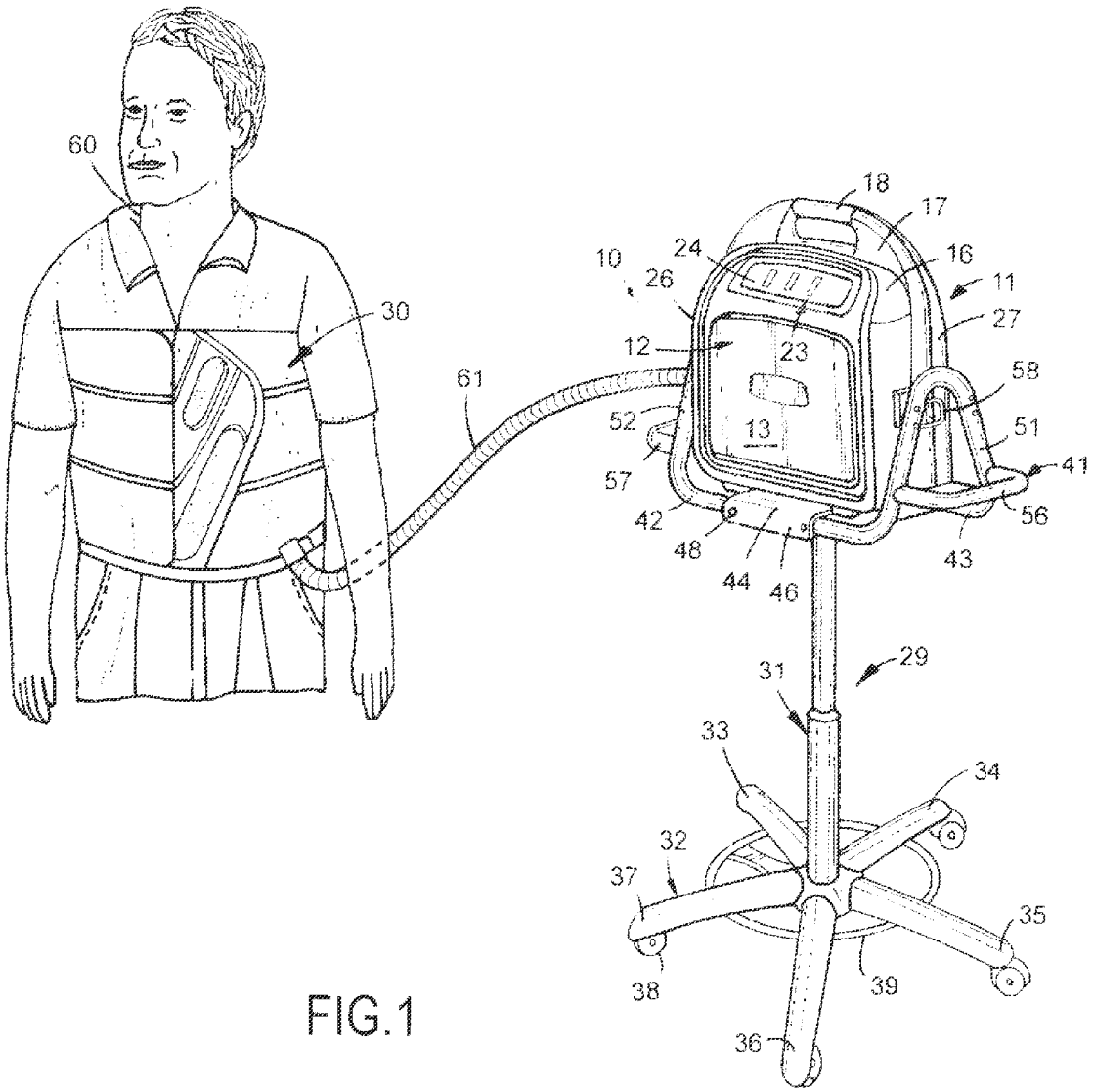
FIG. 1 is a perspective view of a thoracic therapy garment located around the thorax of a person connected with a hose to a pedestal mounted air pulse generator.

A portable human body pulsator 10, shown in FIG. 1, comprises an air pulse generator 11 having a housing 12. A movable pedestal 29 supports generator 11 and housing 12 on a surface, such as a floor. Pedestal 29 allows respiratory therapists and patient care persons to transport the entire human body pulsating apparatus to different locations accommodating a number of persons in need of respiratory therapy and to storage locations. Pulsator 10 can be separated from pedestal 29 and used to provide respiratory therapy to portions of a person's body.

Human body pulsator 10 is a device used with a thoracic therapy garment 30 to apply pressure and repetitive pulses to a person's thorax to provide secretion and mucus clearance therapy. Respiratory mucus clearance is applicable to many medical conditions, such as pertussis, cystic fibrosis, atelectasis, bronchiectasis, cavitating lung disease, vitamin A deficiency, chronic obstructive pulmonary disease, asthma, and immobile cilia syndrome. Post surgical patients, paralyzed persons, and newborns with respiratory distress syndrome have reduced mucociliary transport. Pulsator 10 provides high frequency chest wall oscillations or pulses to enhance mucus and airway clearance in a person with reduced mucociliary transport. High frequency pressure pulses subjected to the thorax in addition to providing respiratory therapy to a person's lungs and trachea, also stimulates the heart and blood flow in arteries and veins in the chest cavity. Muscular and nerve tensions are also relieved by the repetitive pressure pulses imparted to the front, sides, and back portions of the thorax. The lower part of the thoracic cage comprises the abdominal cavity which reaches upward as high as the lower tip of the sternum so as to afford considerable protection to the large and easily injured abdominal organs, such as the liver, spleen, stomach, and kidneys. The abdominal cavity is only subjected to very little high frequency pressure pulses.

Figure 4:
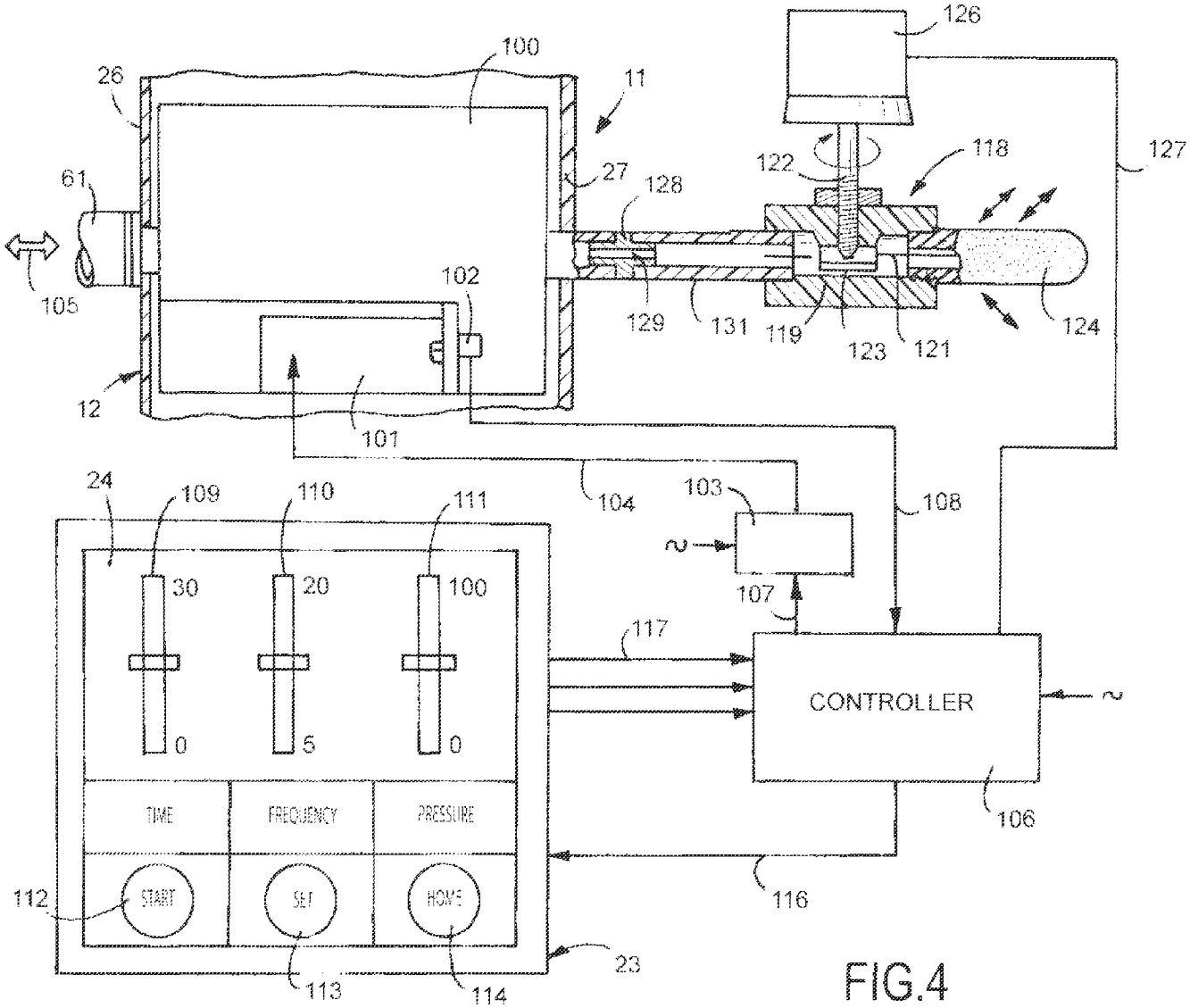
FIG. 4 is a diagram of the user programmable control system for the air pulse generator of FIG. 1.

As shown in FIGS. 1 and 4, housing 12 is a generally rectangular member having a front wall 13 and side walls 26 and 27 joined to a top wall 16. An arched member 17 having a horizontal handle 18 extended over top wall 16 is joined to opposite portions of top wall 16 whereby handle 18 can be used to manually carry air pulse generator 11 and facilitate mounting air pulse generator 11 on pedestal 29. A control panel 23 mounted on top wall 16 has a touch screen 24 including interactive controls to program time, frequency and pressure of air directed to the therapy garment 30. Other control devices including switches and dials can be used to program time, frequency and pressure of air transmitted to therapy garment 30. The screen 24 is readily accessible by the respiratory therapists and user of pulsator 10.

Person care homes, assisted living facilities and clinics can accommodate a number of persons in different rooms or locations that require respiratory therapy or high frequency chest wall oscillations as medical treatments. The portable pulsator 10 can be manually moved to required locations and connected with a flexible hose 61 to a thoracic therapy garment 30 located around a person's thorax. Pulsator 10 can be selectively located adjacent the left or right side of a person 60 who may be confined to a bed or chair.

Pedestal 29 has an upright gas operated piston and cylinder assembly 31 mounted on a base 32 having outwardly extended legs 33, 34, 35, 36 and 37. Other types of linear expandable and contractible devices can be used to change the location of generator 11. Caster wheels 38 are pivotally mounted on the outer ends of legs 33-37 to facilitate movement of body pulsating apparatus 10 along a support surface. One or more wheels 38 are provided with releasable brakes to hold apparatus 10 in a fixed location. An example of a pedestal is disclosed by L. J. Helgeson and Michael W. Larson in U.S. Pat. No. 7,713,219. The piston and cylinder assembly 31 is linearly extendable to elevate air pulsator 10 to a height convenient to the respiratory therapist or user. A gas control valve having a foot operated ring lever 39 is used to regulate the linear extension of piston and cylinder assembly 31 and resultant elevation of pulsator 10. Pulsator 10 can be located in positions between its up and down positions. Lever 39 and gas control valve are operative associated with the lower end of piston and cylinder assembly 31.

A frame assembly 41 having parallel horizontal members 42 and 43 and a platform 44 mounts housing 12 on top of upright piston and cylinder assembly 31. The upper member of piston and cylinder assembly 31 is secured to the middle of platform 44. The opposite ends 46 of platform 44 are turned down over horizontal members 42 and 43 and secured thereto with fasteners 48. Upright inverted U-shaped arms 51 and 52 joined to opposite ends of horizontal members 42 and 43 are located adjacent opposite side walls 26 and 27 of housing 12. U-shaped handles 56 and 57 are joined to and extend outwardly from arms 51 and 52 provide hand grips to facilitate manual movement of the pulsator 10 and pedestal 29 on a floor or carpet. An electrical female receptacle 58 mounted on side wall 27 faces the area surrounded by arm 51 so that arm 51 protects the male plug (not shown) that fits into receptacle 58 to provide electric power to air pulse generator 11. A tubular air outlet sleeve is mounted on side wall 26 of housing 12. Hose 61 leading to thoracic therapy garment 30 telescopes into the sleeve to allow air, air pressure and air pulses to travel through hose 61 to thoracic therapy garment 30 to apply pressure and pulses to a person's body.

Figure 3:
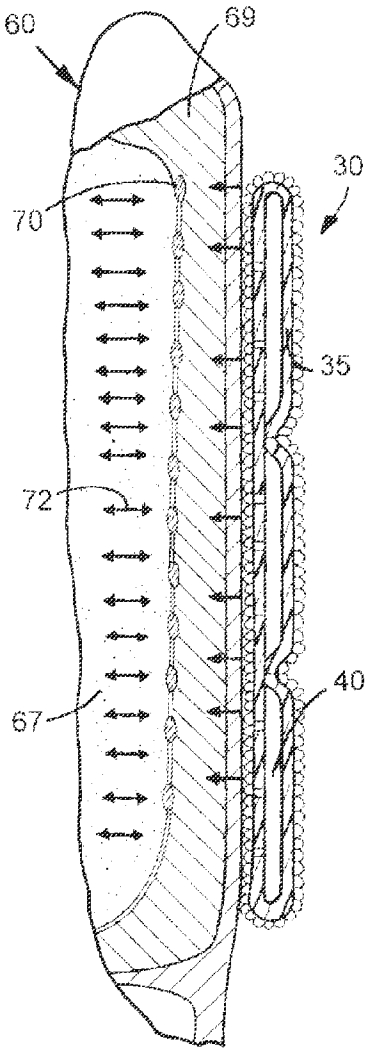
FIG. 3 is an enlarged sectional view of the right side of the thoracic therapy garment of FIG. 2 on the thorax of a person.
Figure 2:
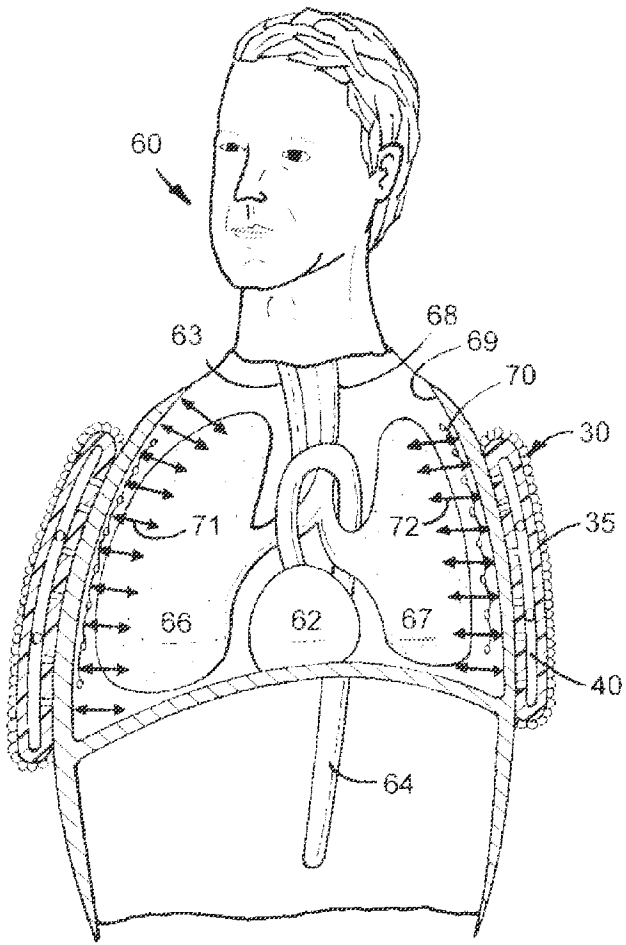
FIG. 2 is a front elevational view, partly sectioned, of the thoracic therapy garment of FIG. 1 located around the thorax of a person.

Thoracic therapy garment 30, shown in FIG. 3, is located around the person's thorax 69 in substantial surface contact with the entire circumference of thorax 69. Garment 30 includes an air core 35 having one or more enclosed chambers 40 for accommodating air pulses and air under pressure. The pressure of the air in the chambers retains garment 30 in firm contact with thorax 69. Air core 35 has a plurality of holes that vent air from chambers 40. Thoracic therapy garment 30 functions to apply repeated high frequency compression or pressure pulses, shown by arrows 71 and 72, to the person's lungs 66 and 67 and trachea 68. The reaction of lungs 66 and 67 and trachea 68 to the pressure pulses causes repetitive expansion and contraction of the lung tissue resulting in secretions and mucus clearance therapy. The thoracic cavity occupies only the upper part of the thoracic cage which contains lungs 66 and 67, heart 62, arteries 63 and 64, and rib cage 70. The high frequency pressure pulses applied to thorax 69 stimulates heart 62 and blood flow in arteries 63 and 64 and veins in the chest cavity. Rib cage 70 also aids in the distribution of the pressure pulses to lungs 66 and 67 and trachea 68.

As shown in FIG. 4, the device includes an air pulse generator 11 having a case 100 located within housing 12. An electric motor 101 mounted on case 100 operates to control the time duration and frequency of the air pulses produced by generator 11 and directed to garment 30. A sensor 102, such as a Hall effect sensor, is used to generate a signal representing the operating speed of motor 101. A motor speed control regulator 103 wired with an electric cable 104 to motor 101 controls the operating speed of motor 101. Other devices can be used to determine the speed of motor 101 and provide speed data to controller 106. A controller 106 having a user programmable controls with memory components wired with an electric cable 107 to motor speed control regulator 103 controls the time of operation of motor 101, the speed of motor 101 and the pressure of air directed to garment 30 shown by arrow 105. The signal generated by sensor 102 is transmitted by cable 108 to controller's lookup data table that coordinates the speed of motor 101 and resulting frequency of the air pulse with a selected air pressure to maintain a selected air pressure when the speed of motor 101 and frequency of the air pulses are changed. The lookup table is an array of digital data of the speed of motor 101 and air pressure created by the air pulse generator precalculated and stored in a static program storage which is initialized by changes in the speed of motor 101 to provide an output to an electric device 126, such as a solenoid or a stepper motor, to regulate air flow control member 122 to maintain a preset or selected air pressure created by air pulse generator 11.

Screen 24 of control panel 23 has three interactive controls 109, 110 and 111. Control 109 is a time or duration of operation of motor 101. The time can be selected from 0 to 30 minutes. Control 110 is a motor speed regulator to control the air pulse frequency between for example 5 and 20 cycles per second or Hz. A change of the air pulse frequency results in either an increase or decrease of the air pressure in garment 30. The pressure of the air in garment 30 is selected with the use of air pressure control 111. The changes of the time, frequency and pressure are manually altered by applying finger pressure along controls 109, 110 and 111. Control panel 23 includes a start symbol 112 operable to connect air pulse generator 11 to an external electric power source. Set and home symbols 113 and 114 are used to embed the selected time, frequency, and pressure in the memory data of controller 106. A cable 116 wires controller 106 with control panel 23. One or more cables 117 wire control panel 23 to controller 106 whereby the time, frequency and pressure signals generated by controls 109, 110 and 111 are transmitted to controller 106. Other types of panels and devices, including switches and dials can be used to provide user input to controller 106.

The air pressure in garment 30 is regulated with a proportional air flow control valve 118 having a variable orifice operable to restrict or choke the flow of air into and out of air pulse generator 11. Valve 118 has a body 119 having a first passage 121 to allow air to flow through body 119. An air flow control member or restrictor 122 having an end extended into the first passage regulates the flow of air through passage 121 into tube 131. Body 119 has a second air bypass passage 123 that allows a limited amount of air to flow into tube 131. The air in passage 123 bypasses air flow restrictor 122 whereby a minimum amount of air flows into air pulse generator 11 so that the minimum therapy treatment will not go down to zero. A cylindrical filter member 124 connected to the air inlet end of body 119 filters and allows ambient air to flow into valve 118. Air flow restrictor 122 is regulated with an electric control device 126, such as a solenoid or a stepper motor. The stepper motor has natural set index points called steps that remain fixed when there is no electric power applied to the motor. Control device 126 is wired with a cable 127 to controller 106 which controls the operation of control device 126. An example of a solenoid air valve is disclosed in U.S. Pat. No. 7,049,917. An example of a stepper motor controlled metering valve is disclosed by G. Sing and A. J. Horne in U.S. Patent Application Publication No. U.S. 2010/0288364. Other types of air flow meters having electronic controls, such as a rotatable grooved ball or a movable disk, can be used to regulate the air flow to air pulse generator 11. An air flow control member 128 has a longitudinal passage 129 is located in tube 131. Member 128 limits the maximum volume of air flowing into and out of air pulse generator 11 to limit peak air pressure in garment 30 to a maximum safe level.

Figure 5:
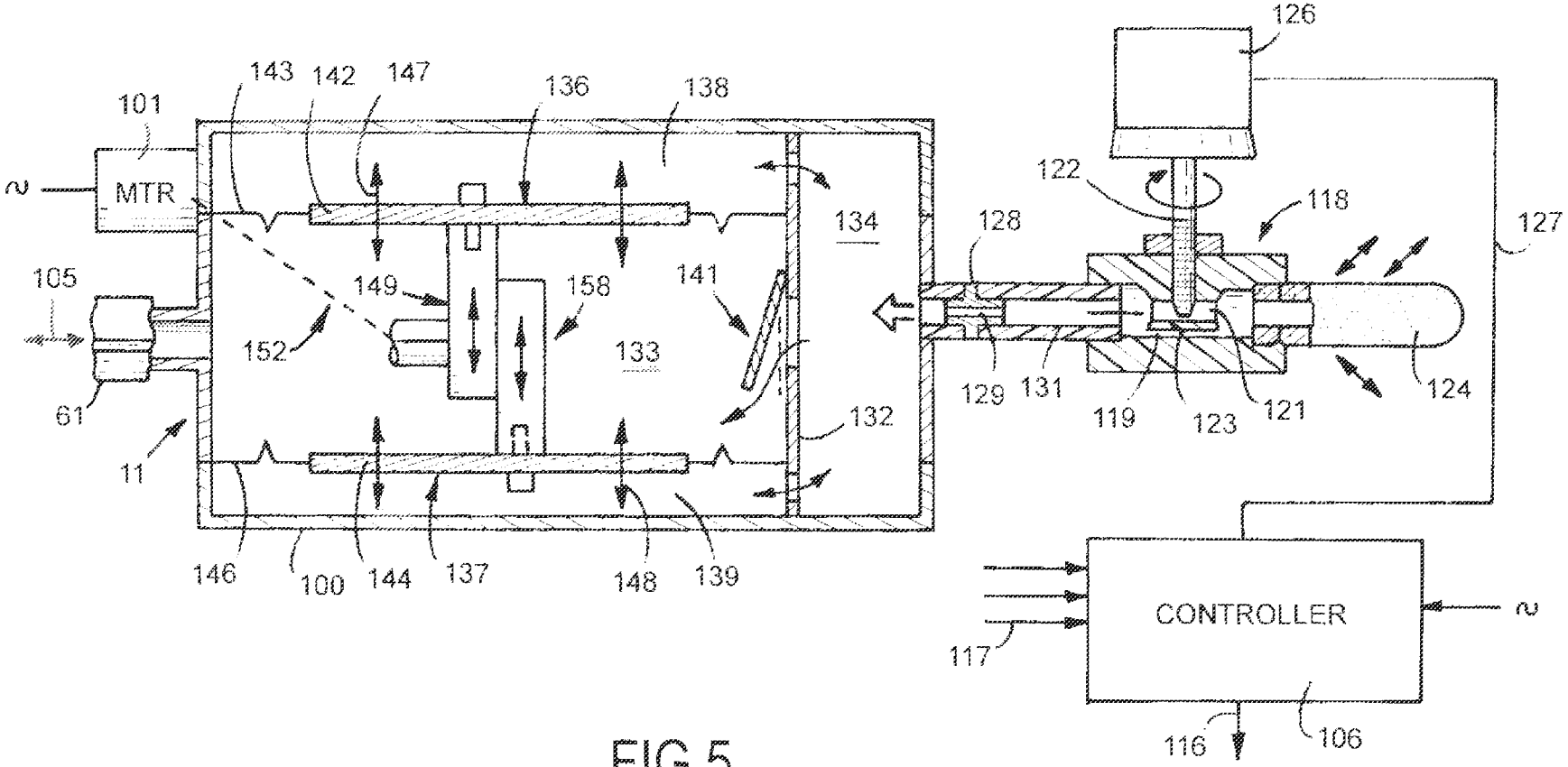
FIG. 5 is a diagram of the user programmable control system for a first embodiment of the air pulse generator.

One embodiment of air pulse generator 11, shown in FIG. 5, has a pulse generator disclosed in U.S. Pat. No. 7,537,575. This pulse generator is incorporated herein by reference. The pulse generator case 100 has an internal wall 132 separating an air pulsing chamber 133 from an air manifold or vestibule chamber 134. A pair of movable members, shown as diaphragms 136 and 137, enclose the air pulsing chamber 133 located between the diaphragms. Pumping chambers 138 and 139 located adjacent the outsides of diaphragms 136 and 137 are in air communication with manifold chamber 134. Diaphragm 136 has a rigid plate 142 joined with a flexible peripheral flange 143 to case 100. Diaphragm 137 has a rigid plate 144 joined with a flexible peripheral flange 146 to case 100. Flanges 143 and 146 allow linear lateral movements of plates 142 and 144 as shown by arrows 147 and 148.

Diaphragms 136 and 137 are linearly moved in opposite lateral directions with linear motion transmission assemblies 149 and 151. The variable speed brushless dc electric motor 101 is drivably connected with a power transmission 157 to motion transmission assemblies 148 and 151. Motion transmission assemblies 149 and 151 are scotch yokes disclosed in U.S. Pat. No. 7,537,575. Other types of motion transmission assemblies can be used to linearly move diaphragms 136 and 137 in opposite lateral directions to draw air into pulse generator 11, increase the air pressure, and pulse the air directed to garment 30.

The proportional air flow valve 118 regulates the air pressure in air pulse generator 11 by adjusting the flow of air into air pulse generator 11. Control device 126 responsive to control signals from controller 106 adjusts the position of air flow restrictor 122 to maintain a selected air pressure in air pulse generator 11 and garment 30. The frequency of the air pulses generated by air pulse generator 11 can be changed by either increased or decreasing the operating speed of motor 101. The change of frequency of the air pulses alters the air pressure in air pulse generator 11 and garment 30. Controller 106 in response to the change of the speed of motor 101 actuates control device 126 to adjust the position of air flow restrictor 122 to maintain a selected air pressure in air pulse generator 11 and garment 30. The controller 106 has lookup data memory table that correlates the speed of motor 101 with air pressure in air pulse generator 11 to maintain a selected air pressure set by the control panel 23 pressure input 111 selected by the person or caregiver.

Figure 6:
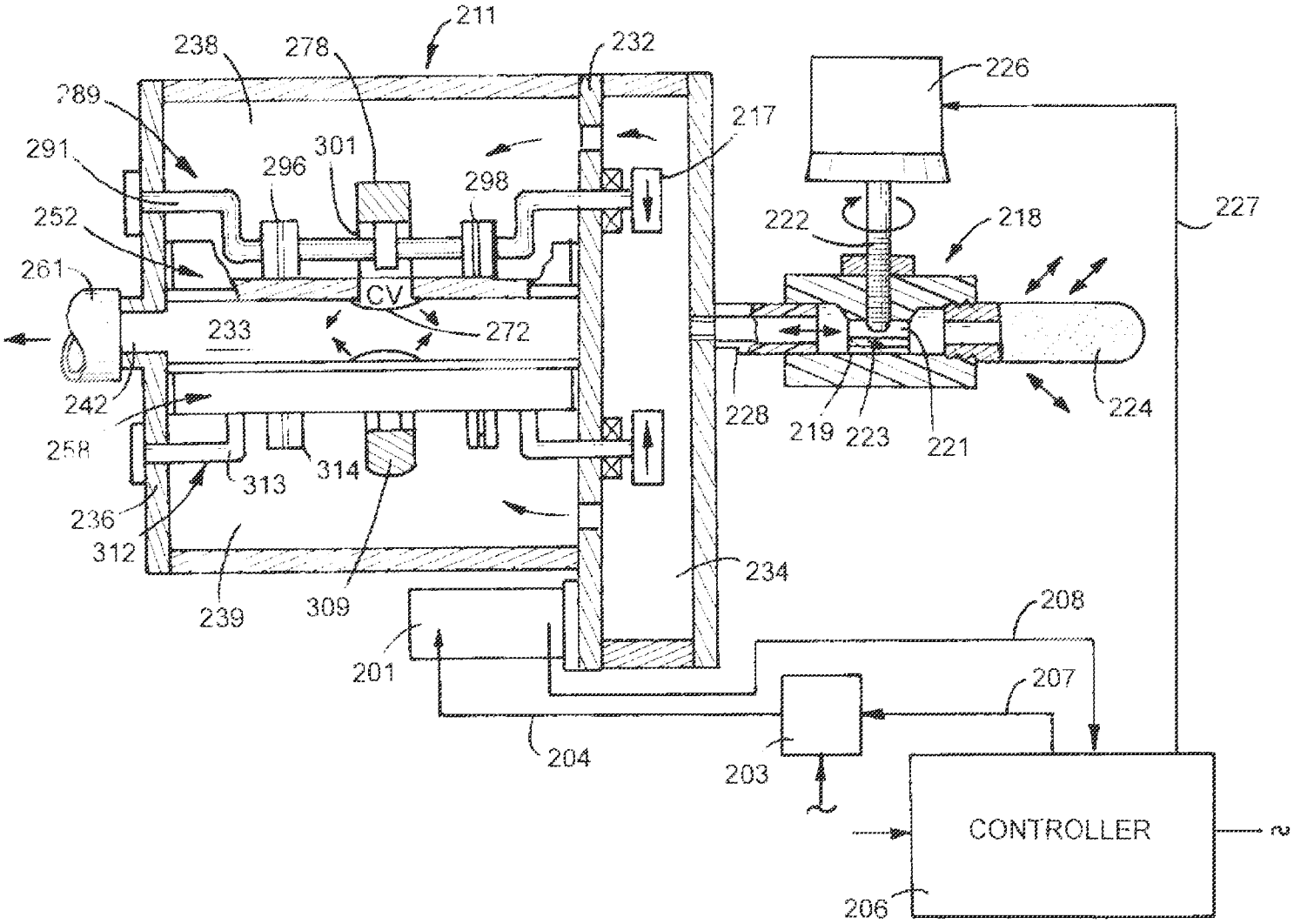
FIG. 6 is a diagram of the programmable control system for a second embodiment of the air pulse generator and user programmable control system.
Figure 7:
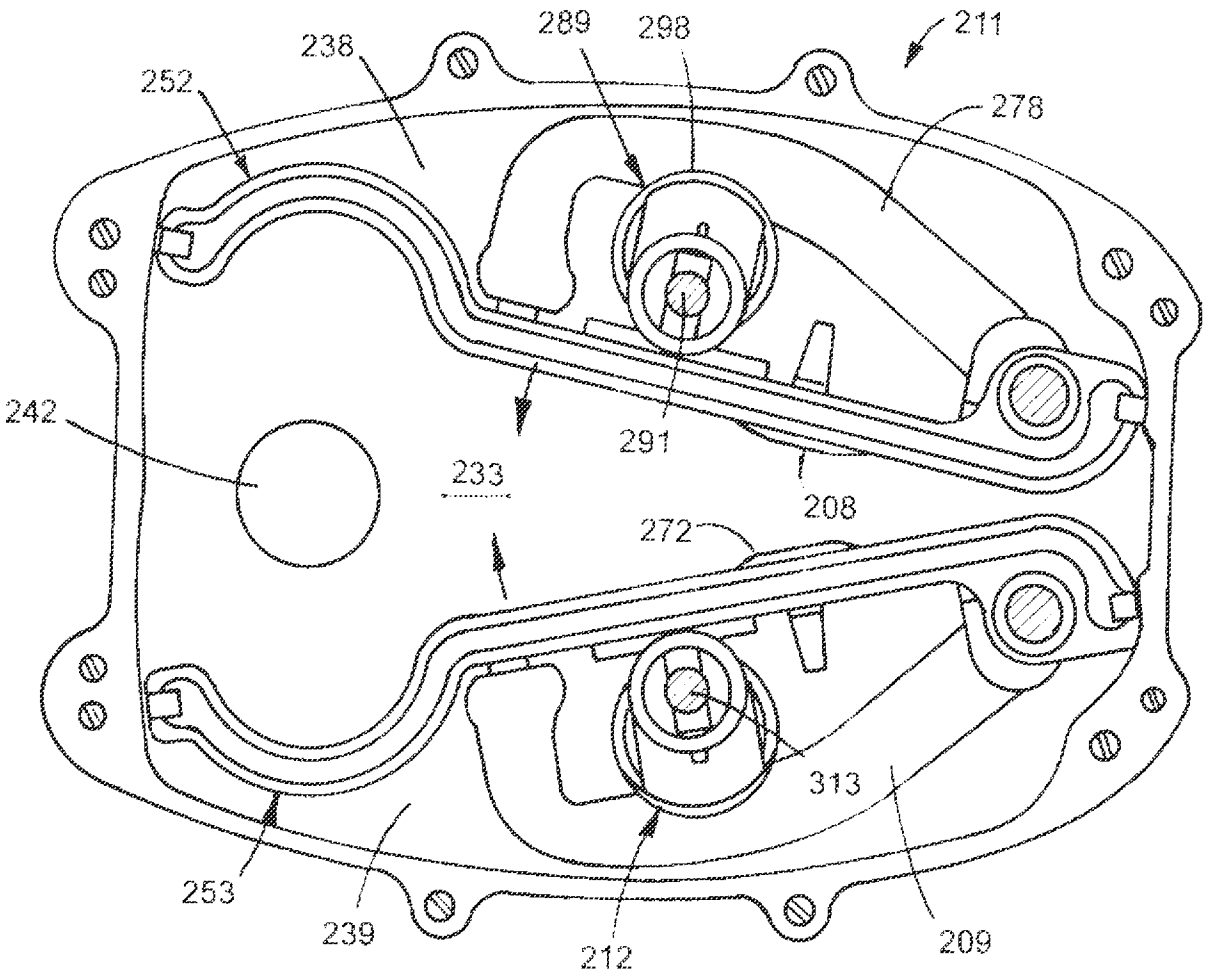
FIG. 7 is an enlarged sectional view taken along line 7-7 of FIG. 6 showing the displacers in the open positions.

A second embodiment of air pulse generator 211, shown in FIG. 6, has an internal wall 232 separating an air pulsing chamber 233 from a manifold chamber 234. A pair of displacers 152 and 153 pivotally mounted on wall 232 and 236 on opposite sides of pulsing chamber 233 are angularly moved to move air through and pulse exit air from air pulse generator 211. Air pumping chambers 238 and 239 adjacent the outsides of displacers 252 and 253 are in air communication with manifold chamber 234. Holes in wall 232 allow air to flow between chambers 234, 238 and 239. Check valves 208 and 272 mounted on displacers 252 and 258 allow air to flow from chambers 238 and 239 into pulsing chamber 233 when displacers 252 and 258 are moved to their open positions as shown in FIG. 7. Air in pulsing chamber 233 flows through a passage 242 into a flexible hose 261 connected to therapy garment 30. Displacers 252 and 253 are angularly moved with power transmission mechanisms 289 and 312 between open and closed positions. Power transmission mechanisms 289 and 312 each include a crankshafts 291 and 313 supporting roller members 296, 298 and 301 operatively associated with displacers 252 and 253 and arms 278 and 309 to angularly move displacers 252 and 253. An electric motor 201 connected to a power transmission assembly 217 rotates crankshafts 291 and 313 of power transmission mechanisms 289 and 312 in opposite rotating directions. Further details of air pulse generator 211 are disclosed in U.S. patent application Ser. No. 13/431,956 incorporated herein by reference.

The air pressure in garment 30 is regulated with a proportional air flow valve 218 having a variable orifice that restricts the flow of air into and out of air pulse generator 211. Valve 218 has a body 219 has a final passage 221 for accommodating air flow through body 219 from a porous air filter member 224 to air pulse generator 211. Body 219 has a second air bypass passage 223 that allows air to flow through body from air filter member 224 to air pulse generator 211. Passage 223 allows for a limited free flow of air to air pulse generator 211 whereby air pulse generator 211 has a supply of air so that therapy treatment will not go down to zero. An air flow control member 228 connects body 219 to air pulse generator 211. Member 228 limits the maximum volume of air flow into and out of air pulse generator 211 to limit peak air pressure in garment 30 to a maximum safe level. An air flow control member or restrictor 222 has an end located in passage 228 for varying the size of passage 221 thereby regulating the flow of air through passage 221. Air flow control member 222 is a threaded rod rotated with a control device 226, such as a solenoid or stepper motor, to vary the flow of air through passage 221. Control device 226 is wired with cable 227 to controller 206 which regulates the operation of control device 226 thereby adjusting air flow control member 222 to regulate the flow of air through passage 221.

Motor 201 is wired with cable 204 to a motor control device 203 operable to regulate the operating speed of monitor 201 as determined by controller 206. A cable 207 wires controller 206 to device 203. Motor 201 includes a motor speed sensor wired with cable 208 to controller 206. The motor speed data from the sensor is digital data used with a lookup table included in controller 206 to maintain a selected air pressure generated by air pulse generator 211 when the speed of motor 201 increases or decreases. The lookup table is an array of digital data of motor speed and air pressure precalculated and stored in static program storage which is initialized by changes in the motor speed to provide an output to stepper motor 226 to regulate air flow control member 222 to maintain a preset or selected air pressure created by air pulse generator 211.

Figure 8:
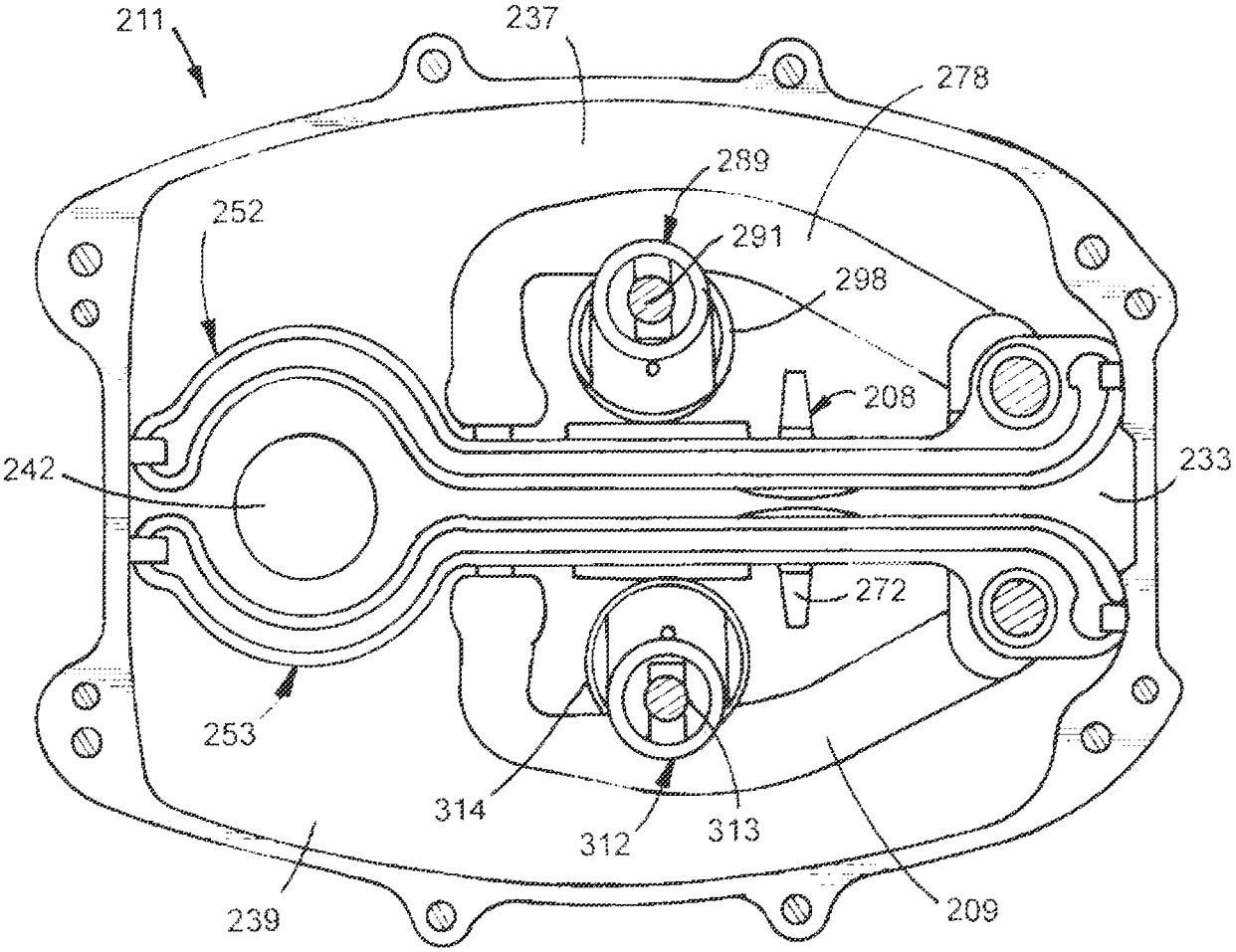
FIG. 8 is an enlarged sectional view similar to FIG. 7 showing the displacers in the closed positions.

In use, displacers 252 and 253, as shown in FIGS. 7 and 8, angularly move between open and closed positions to draw air into chambers 238 and 239 and pulse air out of chamber 233. When displacers 252 and 253 are moved by operation of crankshafts 291 and 313 from the open positions to the closed positions, air is drawn through air flow valve 218 into chambers 234, 238 and 239. Check valves 208 and 272 prevent air to flow from chambers 238 and 239 into pulsing chamber 233. The air in pulsing chamber 233 is forced out through passage 242 into hose 261 coupled to garment 30. When displacers 252 and 253 are moved from the closed positions, shown in FIG. 8, to the open positions, shown in FIG. 7, air flows through check valves 208 and 272 from chamber 238 and 239 into pulsing chamber 233. The air flow in chamber 233 is rhythmically pulsated. The frequency of the air pulses is regulated by the speed of operation of motor 201. An increase in the speed of motor 201 causes an increase in the pressure of the air created by air pulse generator 211. Conversely, a decrease in the speed of motor 201 causes a decrease in the pressure of the air pressure created by air pulse generator 211. Controller 206 with its lookup table and motor speed input actuates control device 226 to regulate air flow control member 222 to adjust the air flow through valve 218 to maintain a selected air pressure in the chamber 233 to compensate for changes of air pressure created by changes in the speed of motor 201. In other words, the selected pressure of the air directed to garment 30 by air pulse generator 211 remains substantially constant when the frequency of the air pulses changes.

The body pulsating apparatus and method disclosed herein are preferred embodiments of the air pulse generator and programmed controls for the time, frequency and pressure operation of the air pulse generator and method. It is understood that the body pulsator is not limited to specific materials, construction, arrangements and method of operation as shown and described. Changes in parts, materials, arrangement and locations of structures may be made by persons skilled in the art without departing from the invention.

The invention claimed is:

1. An apparatus for generating air pressure and high frequency air pulses to a garment having an air core located adjacent the body of a person whereby the body of the person is subjected to pressure and high frequency pulses, the apparatus comprising:

a generator for producing air pressure and high frequency air pulses adapted to be operatively connected to the garment to transmit air pressure and high frequency pulses to the air core of the garment, an electric motor drivably connected to the generator for operating the generator to produce air pressure and high frequency air pressure pulses, a valve for restricting the flow of air to the generator to regulate the air pressure produced by the generator, said valve including an air flow control member for regulating the flow of air to the generator, a control device operably connected to the air flow control member to operate the air flow control member to alter the flow of air to the generator, a controller for regulating the operation of the motor and control device to manage the time duration of operation of the generator, the high frequency of the air pulses and the air pressure produced by the generator, said controller including a first programmable control for regulating the time of operation of the motor and the time duration of the production of the air pressure and high frequency air pressure pulses by the generator, a second programmable control for regulating the speed of the motor to control the high frequency of the air pulses produced by the generator, a third programmable control for regulating the air pressure produced by the generator, said third programmable control including a motor speed and air pressure lookup data table for controlling the operation of the control device to change the operation of air flow control member to alter the flow of air to the generator to maintain a selected air pressure produced by the generator when the speed of the motor and high frequency air pulses are changed.

2. The apparatus of claim 1 wherein: the first programmable control is operable to change the time duration up to 30 minutes.

3. The apparatus of claim 1 wherein: the second programmable control is operable to change the speed of the motor to change the frequency of the air pulses between 5 to 25 pulse per second.

4. The apparatus of claim 1 wherein: the control device is a solenoid operably connected to the air flow control member to change the position of the air flow control member to alter the flow of air to the generator.

5. The apparatus of claim 1 wherein: the control device is a stepper motor operably connected to the air flow control member to change the position of the air flow control member to alter the flow of air to the generator.

6. The apparatus of claim 1 wherein: the generator includes at least one movable member operable to generate air pressure and high frequency air pulses, said motor being operatively associated with the movable member to move the movable member to generate air pressure and high frequency air pulses.

7. The apparatus of claim 1 wherein: the generator includes first and second movable members operable to generate air pressure and high frequency air pulses, said motor being operatively connected to the first and second movable members to move the first and second movable members to generate air pressure and high frequency air pulses.

8. An apparatus for generating air pressure and high frequency air pulses for use in a garment to subject the body of a person to pressure and high frequency pulses, the apparatus comprising:

a generator for producing air pressure and high frequency air pulses for use by the garment to subject a person's body to pressure and high frequency pulses, said generator including a motor operating the generator to produce air pressure and high frequency air pressure pulses, a valve for restricting the flow of air to the generator to regulate the air pressure produced by the generator, a control device operably connected to the valve to operate the valve to alter the flow of air to the device thereby change the air pressure produced by the generator, a controller for regulating the operation of the motor and control device to manage the high frequency air pulse and the air pressure produced by the generator, said controller including a first control for regulating the speed of the motor to establish the high frequency of the air pulses produced by the generator and a second control for regulating the air pressure produced by the generator, said second control including a motor speed and air pressure lookup data table for controlling the operation of the control device to change the operation of the valve to alter the flow of air to the generator to maintain a selected air pressure produced by the generator when the speed of the motor and high frequency air pulses are changed.

9. The apparatus of claim 8 wherein: the valve includes an air flow control member operably connected to the control device whereby operation of the motor regulates the air flow control member to alter the flow of air to the generator to change the air pressure produced by the device when the speed of the motor and high frequency air pulses are changed.

10. The apparatus of claim 9 wherein: the control device is a solenoid operably connected to the air flow control member to change the position of the air flow control member to alter the flow of air to the generator.

11. The apparatus of claim 9 wherein: the control device is a stepper motor operably connected to the air flow control member to change the position of the air flow control member to alter the flow of air to the generator.

12. The apparatus of claim 8 wherein: the first control is a user programmable device.

13. The apparatus of claim 8 wherein: the second control is a user programmable device.

14. The apparatus of claim 8 wherein: the controller includes a user programmable control for regulating the duration of operation of the device.

15. The apparatus of claim 8 wherein: the generator includes at least one movable member operable to generate air pressure and high frequency air pulses, said motor being operatively associated with the movable member to move the movable member to generate air pressure and high frequency air pulses.

16. The apparatus of claim 8 wherein: the generator includes first and second movable members operable to generate air pressure and high frequency air pulses, said motor being operatively connected to the first and second movable members to move the first and second movable members to generate air pressure and high frequency air pulses.

17. A method of applying pressure and high frequency pulses to the body of a person, the method comprising:

locating a garment having an air core adjacent a portion of the body of a person to be subjected to pressure and high frequency pulses, generating air pressure and high frequency air pulses with a generator for producing air pressure and high frequency air pulses, transferring the air pressure and high frequency air pulses to the air core of the garment whereby pressure and high frequency pulses are applied to the body of the person, drivably connecting the generator to a motor used to operate the generator to produce the air pressure and high frequency air pressure pulses, restricting the flow of air to the generator to regulate the air pressure produced by the generator with a valve having an air flow control member operable to alter the flow of air to the generator, drivably connecting the air flow control member to a control device to operate the air flow control member to alter the flow of air to the generator and air pressure produced by the generator, regulating the operation of the motor and control device to manage the time duration of operation of the generator, the high frequency of the air pulses and the air pressure produced by the generator, and providing a user programmable control to maintain a selected air pressure produced by the generator responsive to changes in the frequency of the air pulses produced by the generator.

18. The method of claim 17 including: providing a user programmable control for regulating the time of operation of the motor and the time duration of the production of air pressure and high frequency air pressure pulses by the generator.

19. The method of claim 17 including: providing a user programmable control for regulating the speed of the motor to regulate the high frequency of the air pulses produced by the generator.

20. The method of claim 17 including: providing the user programmable control for regulating the air pressure produced by the device with a motor speed and air pressure lookup data table for controlling the operation of the control device to maintain a selected air pressure produced by the device when the speed of the first motor and high frequency air pulses are changed.

21. The method of claim 17 including:

providing a first user programmable control for regulating the speed of the first motor to regulate the high frequency of the air pulses produced by the device, providing a second user programmable control for regulating the air pressure produced by the device with a motor speed and air pressure lookup table for controlling the operation of the control device to regulate the air pressure produced by the generator to maintain a selected air pressure produced by the generator when the speed of the motor and high frequency air pulses are changed.

* * * * *